US006668949B1

(12) United States Patent
Rives

(10) Patent No.: US 6,668,949 B1
(45) Date of Patent: Dec. 30, 2003

(54) UNDERREAMER AND METHOD OF USE

(76) Inventor: Allen Kent Rives, 11831 Pebbleton, Houston, TX (US) 77007

( * ) Notice: Subject to any disclaimer, the term of this patent is extended or adjusted under 35 U.S.C. 154(b) by 0 days.

(21) Appl. No.: 09/913,626

(22) PCT Filed: Oct. 21, 2000

(86) PCT No.: PCT/US00/41431

§ 371 (c)(1),
(2), (4) Date: Aug. 17, 2001

(87) PCT Pub. No.: WO01/29364

PCT Pub. Date: Apr. 26, 2001

Related U.S. Application Data

(60) Provisional application No. 60/160,678, filed on Oct. 21, 1999.

(51) Int. Cl.[7] ..... E21B 10/32; E21B 7/04

(52) U.S. Cl. ..... 175/269; 175/266; 175/267; 175/279; 175/284; 175/285; 175/292

(58) Field of Search ..... 175/52, 267, 269, 175/266, 279, 284, 285, 292

(56) References Cited

U.S. PATENT DOCUMENTS

| | | | | | |
|---|---|---|---|---|---|
| 1,478,306 | A | | 12/1923 | Sweetman | 175/269 |
| 2,679,383 | A | | 5/1954 | Garrison | 175/269 |
| 2,725,936 | A | | 12/1955 | Hester | 166/55.8 |
| 2,756,968 | A | * | 7/1956 | Emanuel et al. | 175/269 |
| 2,872,160 | A | * | 2/1959 | Barg | 175/269 |
| 3,208,540 | A | * | 9/1965 | Park | 175/269 |
| 3,220,478 | A | | 11/1965 | Kinzbach | 166/55.8 |
| 3,506,077 | A | * | 4/1970 | Leathers et al. | 175/267 |
| 3,552,509 | A | * | 1/1971 | Brown | 175/258 |
| 4,431,065 | A | * | 2/1984 | Andrews | 175/269 |
| 4,461,361 | A | | 7/1984 | Fuchs | 175/269 |
| 4,865,137 | A | * | 9/1989 | Bailey et al. | 175/269 |
| 5,060,736 | A | * | 10/1991 | Neff | 175/74 |
| 5,060,738 | A | | 10/1991 | Pittard et al. | 175/267 |
| 5,139,098 | A | | 8/1992 | Blake | 175/269 |
| 5,201,817 | A | | 4/1993 | Hailey | 175/269 |
| 5,332,048 | A | | 7/1994 | Underwood et al. | 175/267 |
| 5,402,856 | A | * | 4/1995 | Warren et al. | 175/57 |
| 5,485,888 | A | | 1/1996 | England | 175/53 |
| 5,678,644 | A | | 10/1997 | Fielder | 175/391 |
| 5,896,940 | A | | 4/1999 | Pietrobelli et al. | 175/269 |
| 6,009,961 | A | * | 1/2000 | Pietrobelli et al. | 175/269 |

* cited by examiner

*Primary Examiner*—David Bagnell
*Assistant Examiner*—G M Collins
(74) *Attorney, Agent, or Firm*—David B. Dickinson; H. Lee Huddleston; Lundeen & Dickinson LLP

(57) ABSTRACT

An underreamer (5) is formed from a tubular body (10) having a longitudinal bore therethrough, and providing an integral piston actuator (20) responsive to hydraulic pressure to move cutters (40) into engagement with the well bore and springs (60) to resist premature engagement of the cutter arms (40) and to return the cutters (40) to the body upon conclusion of the underreaming job. Skewed longitudinal grooves (45) are formed in the tubular body thereby permitting the flowpath through the underreamer to provide substantially the same inner diameter throughout the tool (5).

21 Claims, 12 Drawing Sheets

UNDERREAMER AND METHOD OF USE

CROSS REFERENCE TO RELATED APPLICATION

This application is a national stage filing under 35 U.S.C. §371 of PCT/US00/41431, filed Oct. 21. 2000 which claims the benefit of a provisional U.S. application U.S. Ser. No. 60/160,678, filed Oct. 21. 1999, by applicant.

An underreamer is a device used to enlarge the well bore below the casing. Currently used underreamers are long assemblies having blades or cutters which are moved into the well bore by mechanical means to enlarge the hole. The mechanisms for moving the cutter faces into the well bore have significantly impinged on interior space of the body and consequently restricted the fluid passage from the upper end of the underreamer to the lower end. Currently used underreamers have been long and heavy making them impractical to use with steerable downhole motors to simultaneously drill and underream.

An underreamer of the present invention is made up of a tubular upper body, threadedly connectable to a drill string, said tubular upper body having a lower end and an upper end each with a different internal diameter, wherein the inner diameter of the lower end is larger than the inner diameter of the upper end. It has a tubular lower body removably attached to the lower end of the tubular upper body, said tubular lower body having at least three skewed, longitudinal grooves and an interior surface defining a longitudinal bore therethrough and an annular lip within the tubular lower body which permits a flowpath having substantially the same diameter through the entire underreamer. It also provides a piston actuator having a longitudinal annular bore, at least three extensions, each having a slot formed thereon, and upper and lower portions, wherein said upper portion slideably and sealingly engages the interior surface of the lower end and wherein the lower portion slideably and sealingly engages the interior surface of tubular lower body and has a lower surface; at least three pins; at least three cutters, each having an ear formed thereon, wherein each of the cutters is pivotally attached within a corresponding one of said at least three skewed, longitudinal grooves using one of the at least three pins and wherein said ear engages the slot of a corresponding one of said at least three extensions; and at least one resilient member positioned between the lower surface of piston actuator and the annular lip of the tubular lower body, said at least one resilient member resisting downward longitudinal movement of the piston actuator assembly. The longitudinal movement of the piston actuator moves the arms into and out of engagement with the well bore and does not rely upon pins and linkages commonly found in prior art underreamers.

The present invention offsets the support mechanism of the cutter surfaces of the underreamer from the central longitudinal axis of the tool so that an unobstructed passageway through the tubular body may be provided. It is an object of the present invention to provide a shortened underreamer for use in all forms of drilling operations, including directional drilling operations and drilling programs using steerable downhole drilling motors to permit directional underreaming of formations. The present invention allows drilling and underreaming to occur in one continuous operation and saves the operator the time and expense of drilling a pilot hole then tripping into and out of the hole or reentering the well to underream the pilot hole. The shortened body length of the present invention also allows steerable underreaming while drilling in an economical package. The present invention also avoids the necessity of costly bicentered bit technologies and the inherent weaknesses of conventional underreamers. The present invention permits the simultaneous use of small and therefore cheaper bit technologies with the underreamer and also permits directional control of the underreamer and bit combination.

Most generally, the present invention consists of an apparatus formed from a tubular body having threaded connections at each end, an interior surface forming a longitudinal bore through said tubular body and an annular lip within said tubular body, and a plurality of skewed, longitudinal grooves formed in said body; a piston actuator having a lower surface, a plurality of slotted extensions and a longitudinal flow path through said piston actuator, wherein said piston actuator slideably and sealingly engages the interior surface; a plurality of arms, each of said arms having a pivot and an ear, wherein each of said plurality of arms is pivotally mounted in a corresponding one of said plurality of skewed, longitudinal grooves and wherein said ear is adjacent to said pivot and engages a corresponding one of said plurality of slotted extensions; and a plurality of resilient members, wherein each of said plurality of resilient members has a first end and a second end, is located adjacent to a corresponding one of said plurality of slotted extensions, the first end engages the lower surface of the piston actuator, and the second end engages the annular lip.

DETAILED DESCRIPTION

Figure 1:
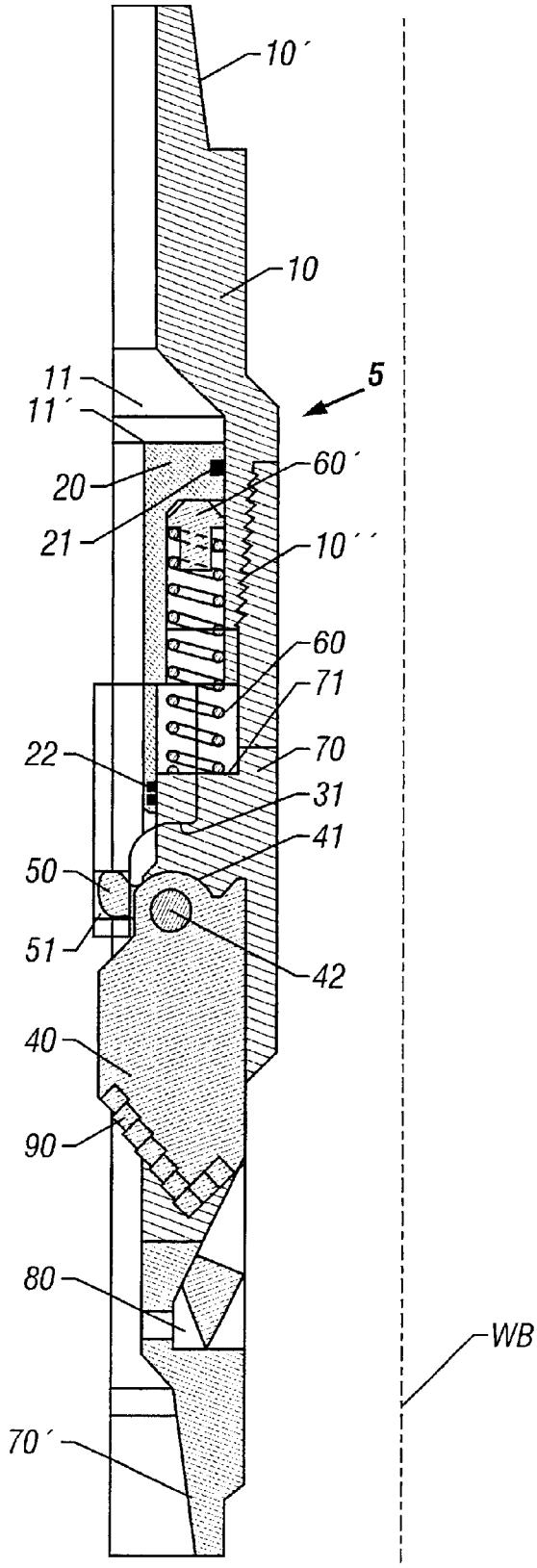
FIG. 1 is a half-sectional view of the underreamer in its closed position.
Figure 4:
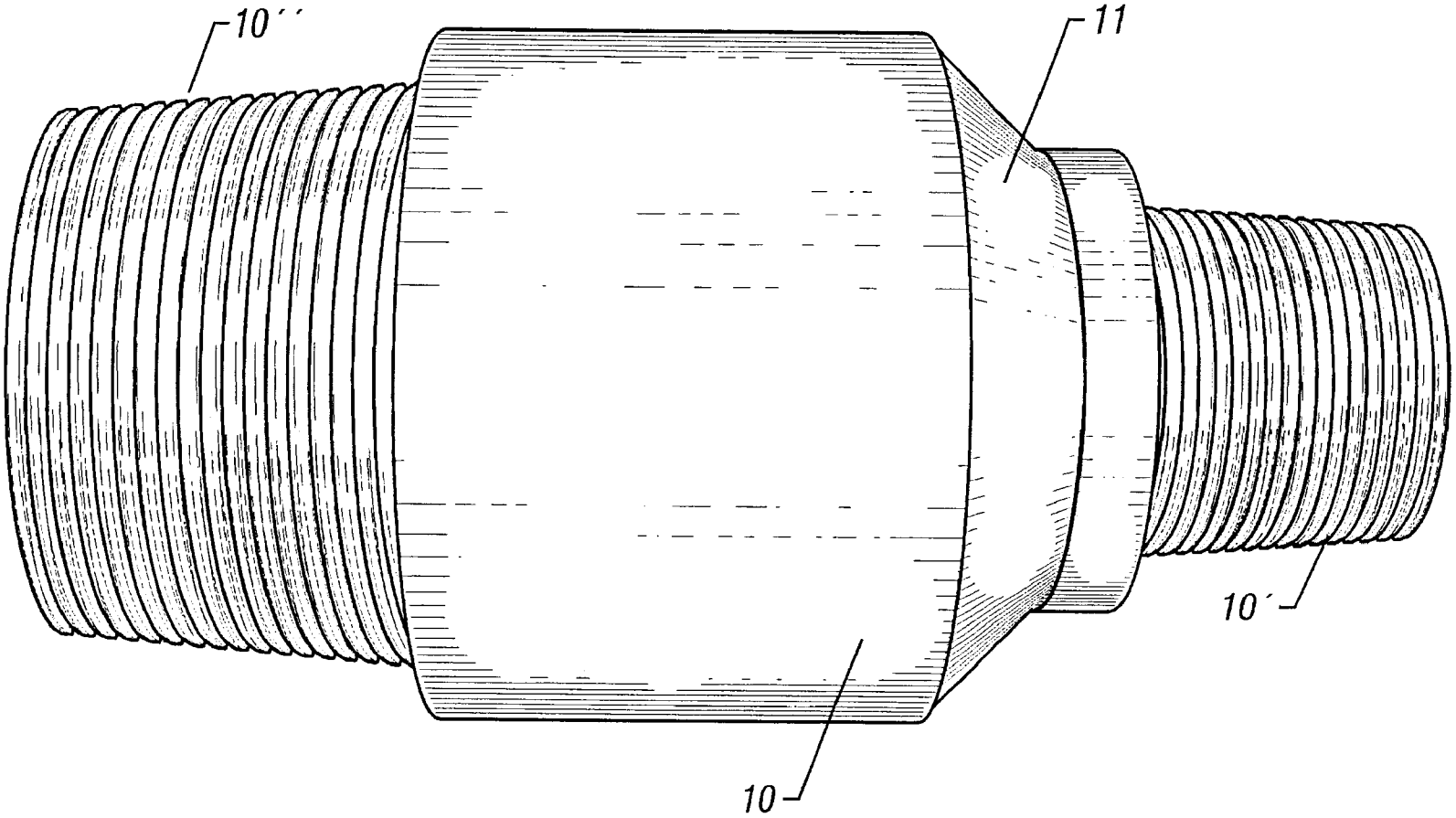
FIG. 4 is a perspective view of the upper sub of the underreamer.

FIG. 1 is a half-section view of the underreamer 5 of the present invention showing the cutter blades 40 in the closed position as the underreamer is being tripped into or out of the well bore. The underreamer is provided with threads at 10' and 70' in a manner well known in the art for attachment within a drill string. Threads 10' may be used to attach the underreamer 5 to a downhole motor, a drill collar assembly, or a standard drill pipe assembly in a manner well known to those in drilling industry. Threads 70' may be used to connect the underreamer 5 to drill bits (including specializaed drill bits such as a polycrystalline diamond (PDC) bit) or to drill collars or they may be connected to a bull nose to underream a pilot hole previously drilled. The underreamer 5 is formed with an upper sub 10 providing an annular passageway therethrough and terminating with an enlarged inner diameter 11. The upper sub 10 is threadably connected to the underreamer lower body 70 by threads 10" in a manner well known to those skilled in the manufacture of downhole tools. A perspective view of the upper sub 10 is shown in FIG. 4. The enlarged lower interior diameter 11 of the upper sub 10 provides a slick bore which provides for slideable engagement of an integral piston actuator 20, which extends into underreamer lower body 70. The assembly 20 provides grooves for dynamic seals 21 and 22 to permit hydraulic pressure to be maintained through the underreamer to the drill bit, for example, as the piston actuator 20 moves in the slick bore of body 70. Piston actuator 20 is a cooperative assembly which is moved in response to increased mud pump pressure down the annulus of the underreamer tubular body 5. A resilient member comprising a spring extender 60' and spring 60, which are engaged between the body 70 and the lower surface of the piston actuator 20, resist downward movement of the piston actuator 20.

Figure 5:
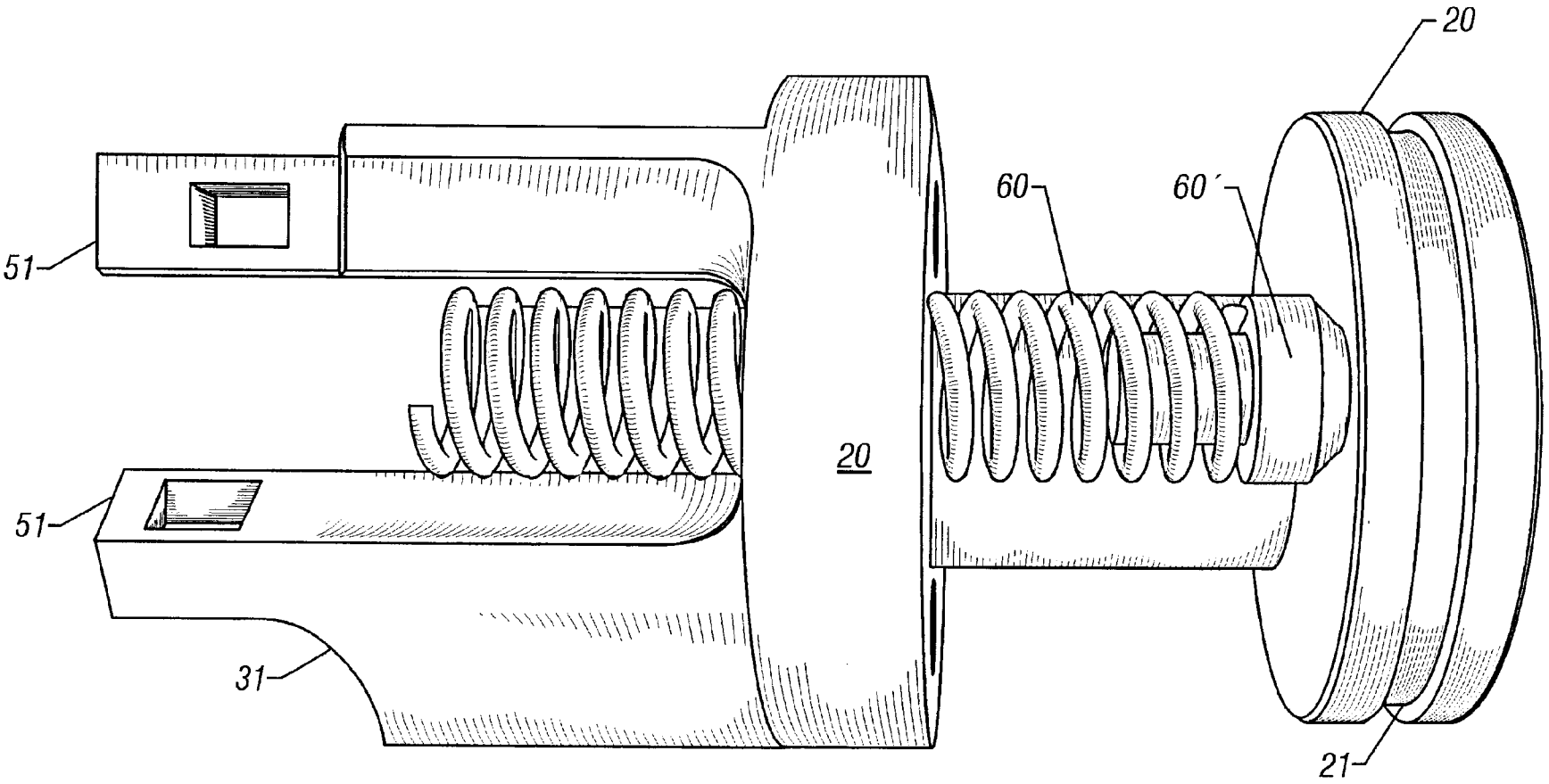
FIG. 5 is a perspective view of the piston actuator with the spring and spring extender inserted.
Figure 6:
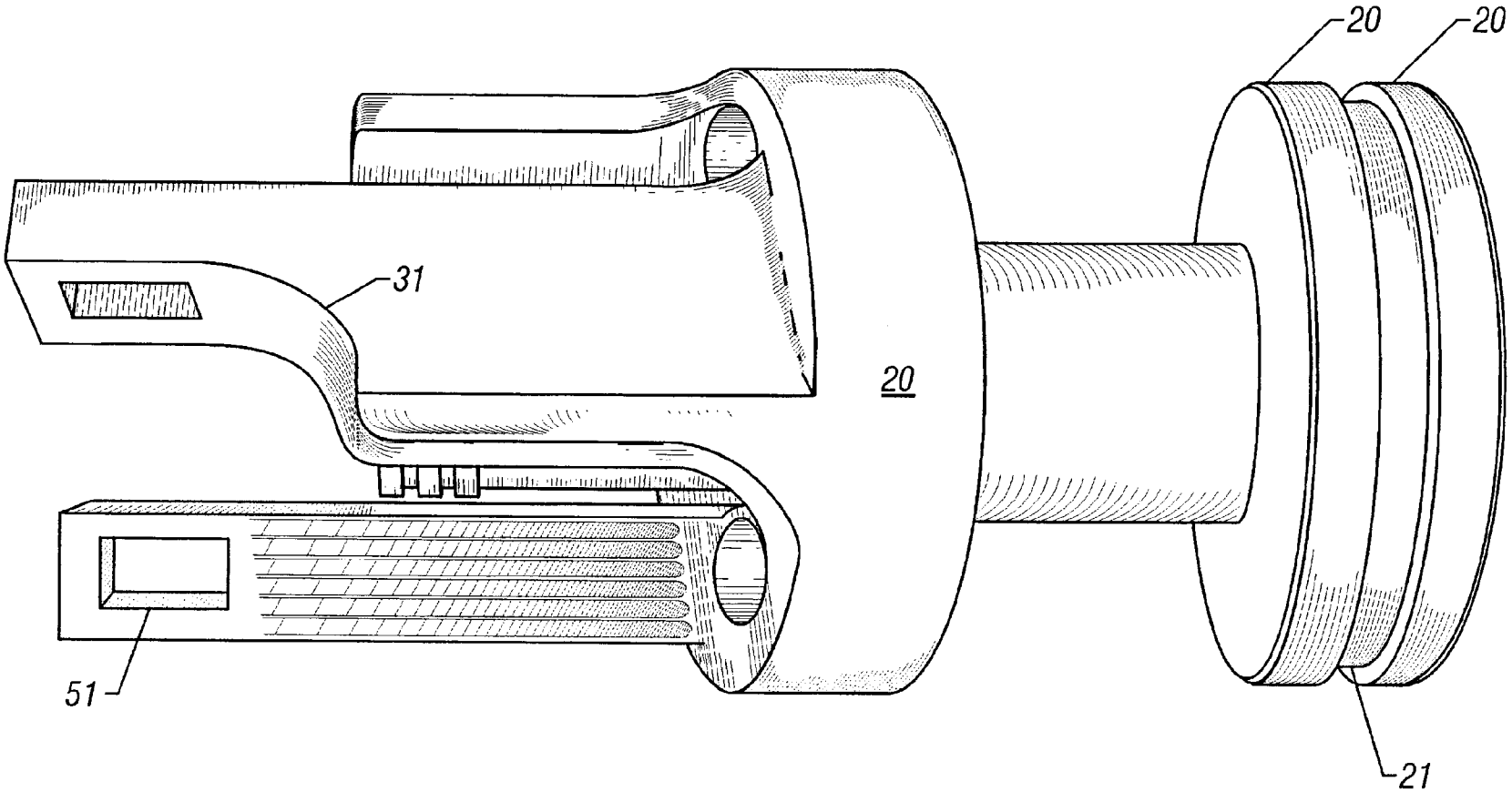
FIG. 6 is a perspective view of the piston actuator with the slots for engaging the ear of the cutter blades.
Figure 7:
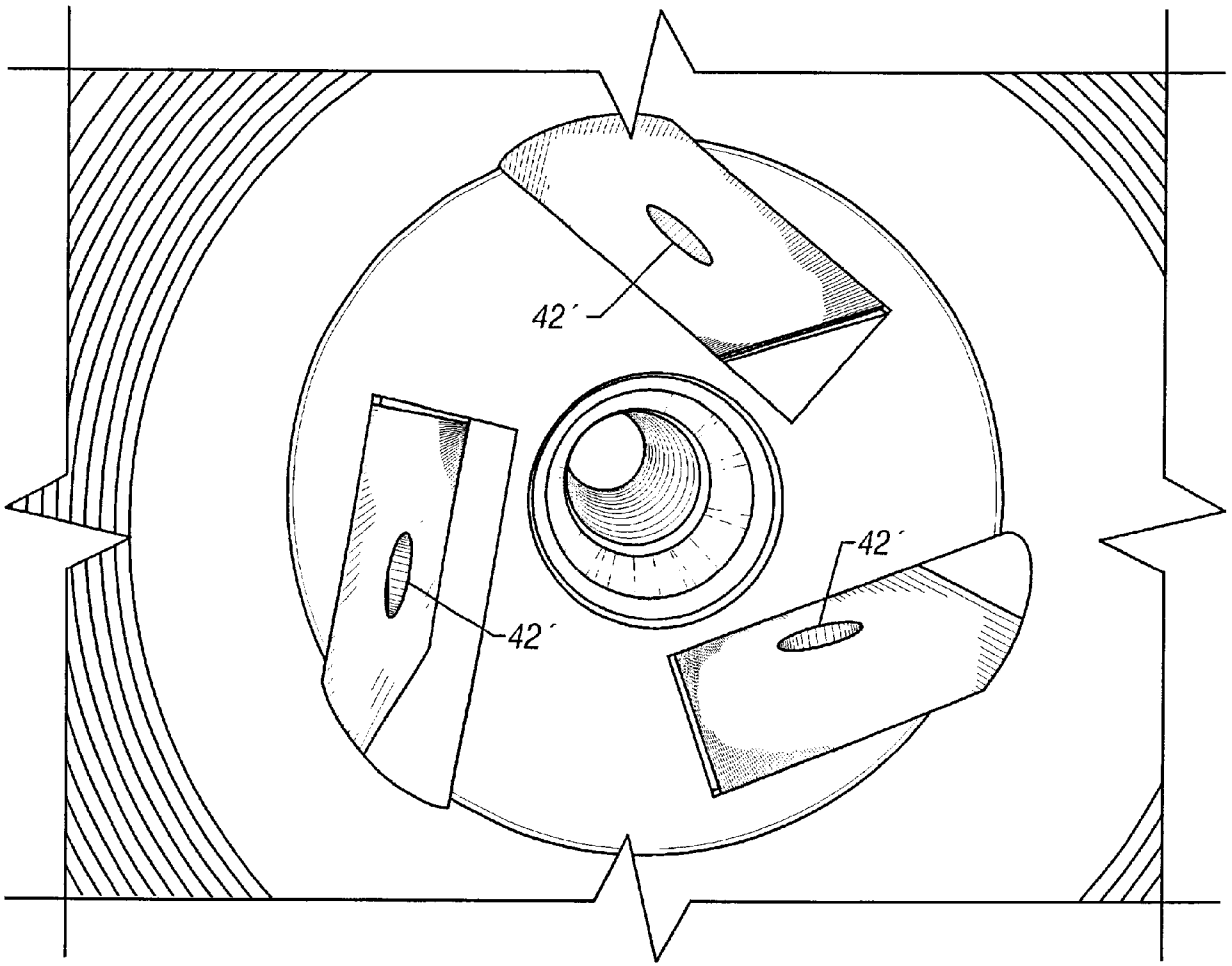
FIG. 7 is a perspective view of the top interior view of the underreamer tubular body showing the offset, skewed position of the cutter blade slots.

The underreamer 5 is actuated by differential pressure against the upper surface of piston actuator 20 that moves the piston down against the resilient member extender 60' and resilient member 60 which seat against the annular lip or shoulder 71 on the interior surface of the underreamer tubular body 70. FIG. 5 is a perspective view of the piston actuator 20 with the resilient member 60 and resilient member extender 60' shown. The lower end of piston actuator 20 provides extensions having slots 51 machined therein. The piston actuator lower surface also provides a profiled surface 31 designed to mate and lock with the cooperating surface 41 on the cutter 40. FIG. 6 provides a perspective view of the portion of the piston actuator 20 with the slots 51 and surface 31 as described. The extensions or arms of piston actuator 20 are disposed in the skewed cutter grooves provided by the underreamer body 70. FIG. 7 shows a top view of the underreamer body 70 with the skewed exterior grooves that accept the extensions of piston actuator 20 at oblique angles to the central axis of the underreamer body, thereby permitting an unrestricted fluid passageway through the annulus of the tool. FIG. 7 also shows the holes 42' drilled in the underreamer body 70 to accept the pins 42 that rotatably support the cutters 40.

Figure 9:
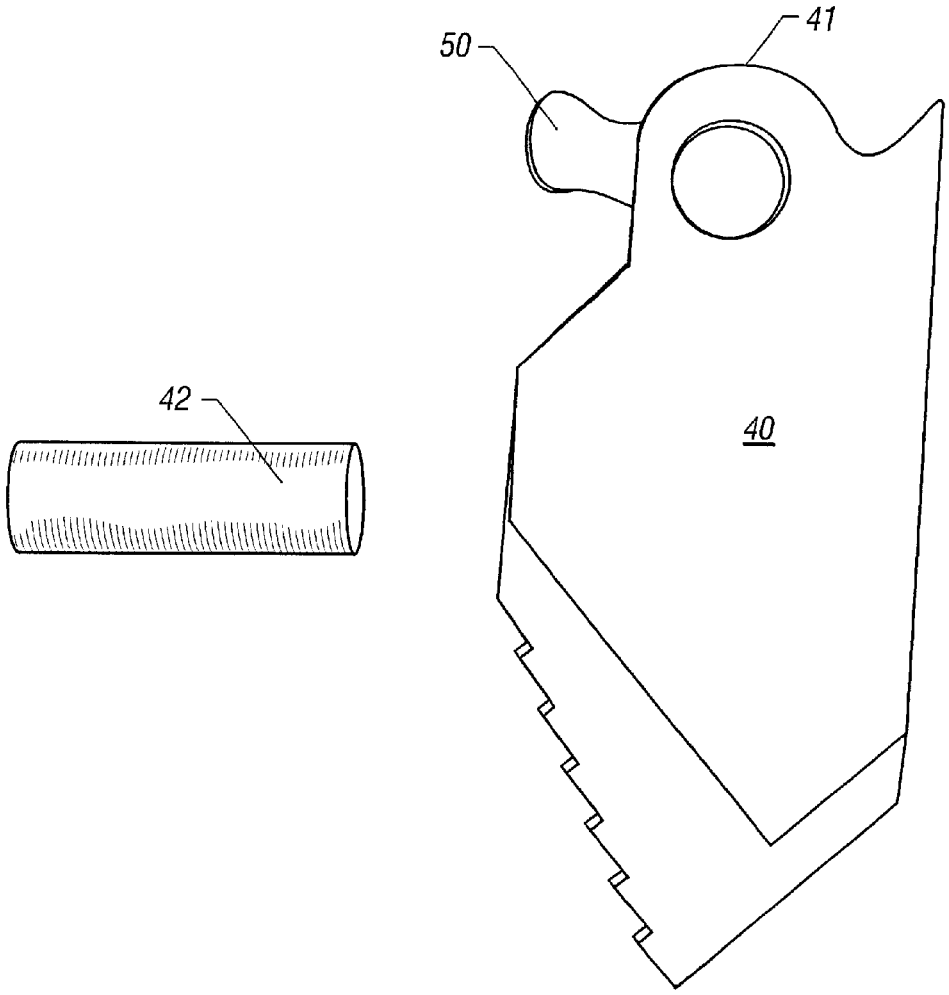
FIG. 9 is a perspective view of the cutter blade before assembly with the carbide buttons and showing the pin used to pivotally connect the blade to the underreamer body.
Figure 10:
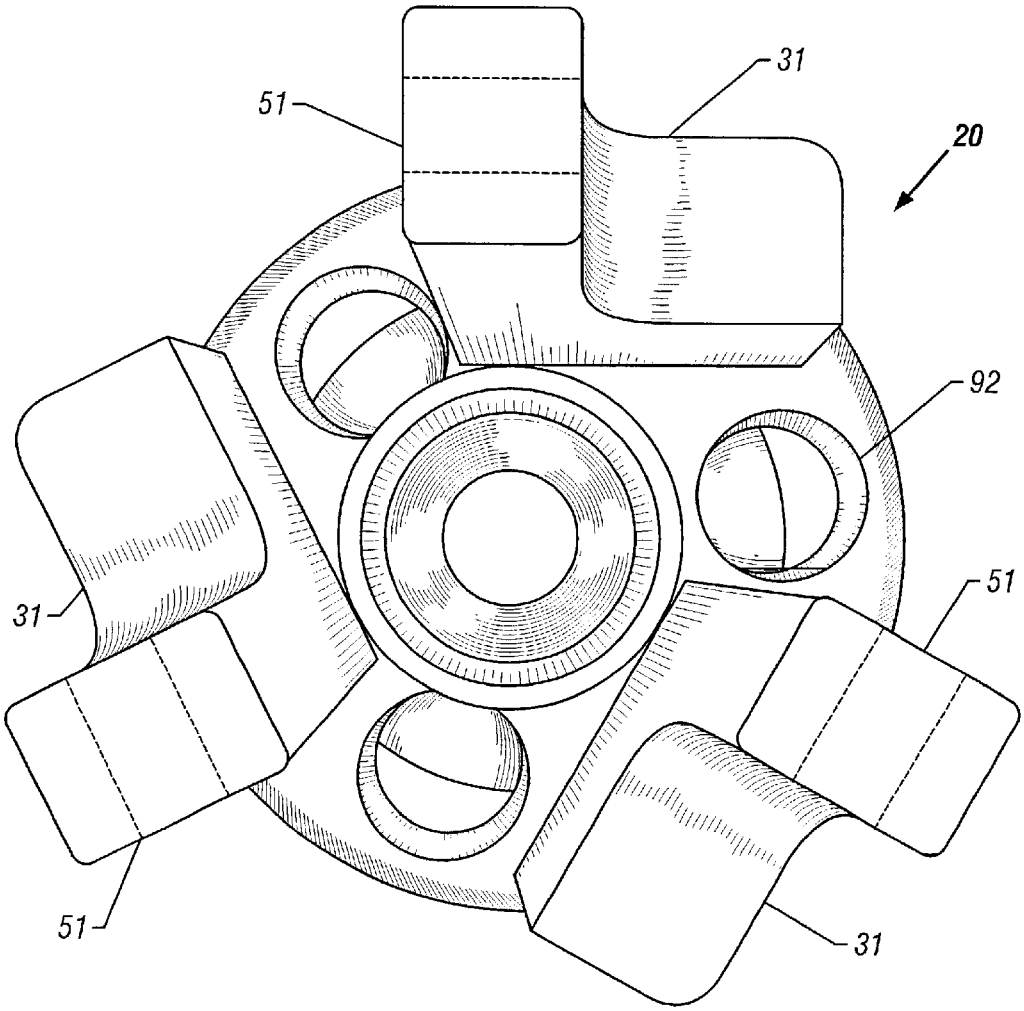
FIG. 10 is a perspective view of the lower end of the piston actuator.

As is shown in FIG. 1, cutter 40 provides at its upper end an ear 50 that fits within the slot 51 of the piston actuator 20. The cutter 40 is connected to the underreamer body 70 by pin 42 that pivots the cutter 40 when the piston actuator 20 is moved longitudinally against the ear 50. This obviates the need for multiple pin and linkage connections found in many prior art underreamer devices. FIG. 9 is a perspective view which shows the cutter 40 and the ear 50 and specific profile of the cutter 41 which mates with the profile 31 of the piston actuator 20 as shown in FIG. 1. As the piston actuator 20 moves longitudinally in response to hydraulic pressure acting against the piston face 11', the cutter 40 is moved from its closed position (as shown in FIG. 1) into engagement with the well bore (shown in FIG. 2, and in FIG. 3 as WB) for underreaming or stabilizing. The lower surface 31 of the piston actuator 20 mates with the upper surface 41 of the cutter to lock said cutter 40 in its extended position for underreaming. As may be more fully appreciated from FIGS. 1 and 2, port and jetting arrangement 80 provide fluid communication from the interior of the underreamer body 70 to the area adjacent the cutting surface to carry cuttings away from the cutters 40 and to prevent balling up of material in loose or unconsolidated formations. The manner of making and installing said ports and jets are well known in the industry and are only schematically shown in the drawings.

Figure 2:
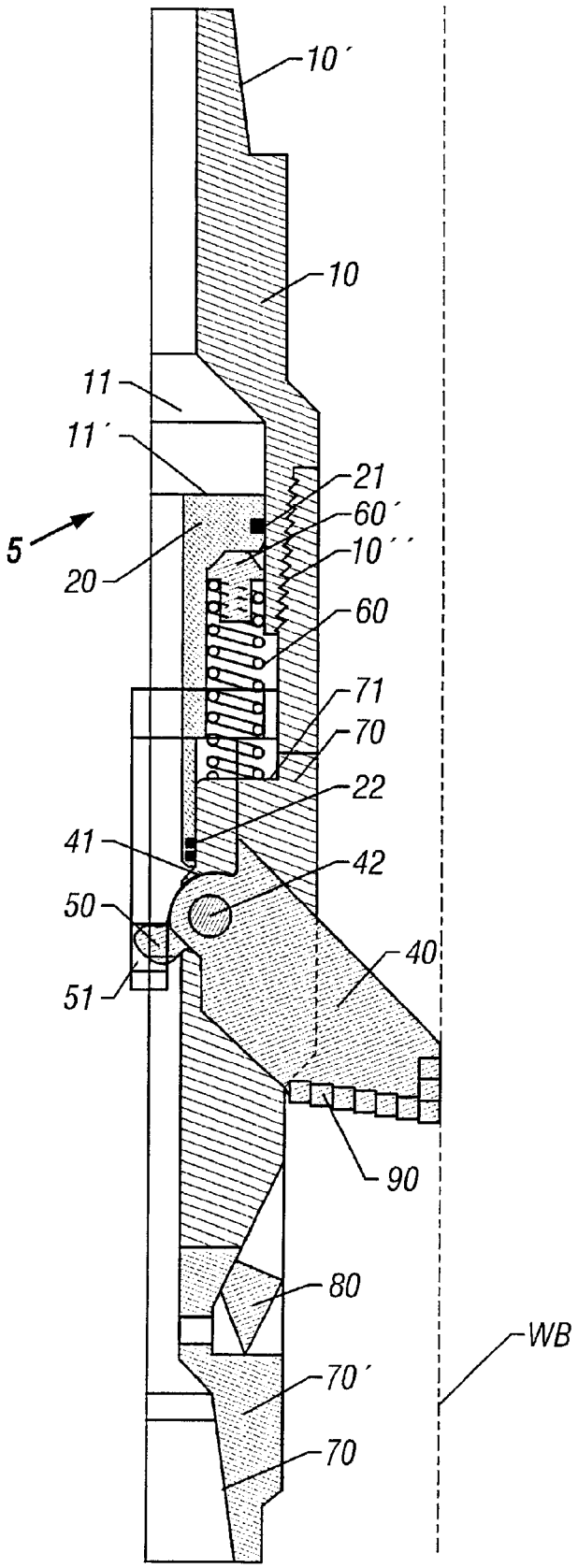
FIG. 2 is a half-sectional view of the underreamer in its open position.
Figure 8:
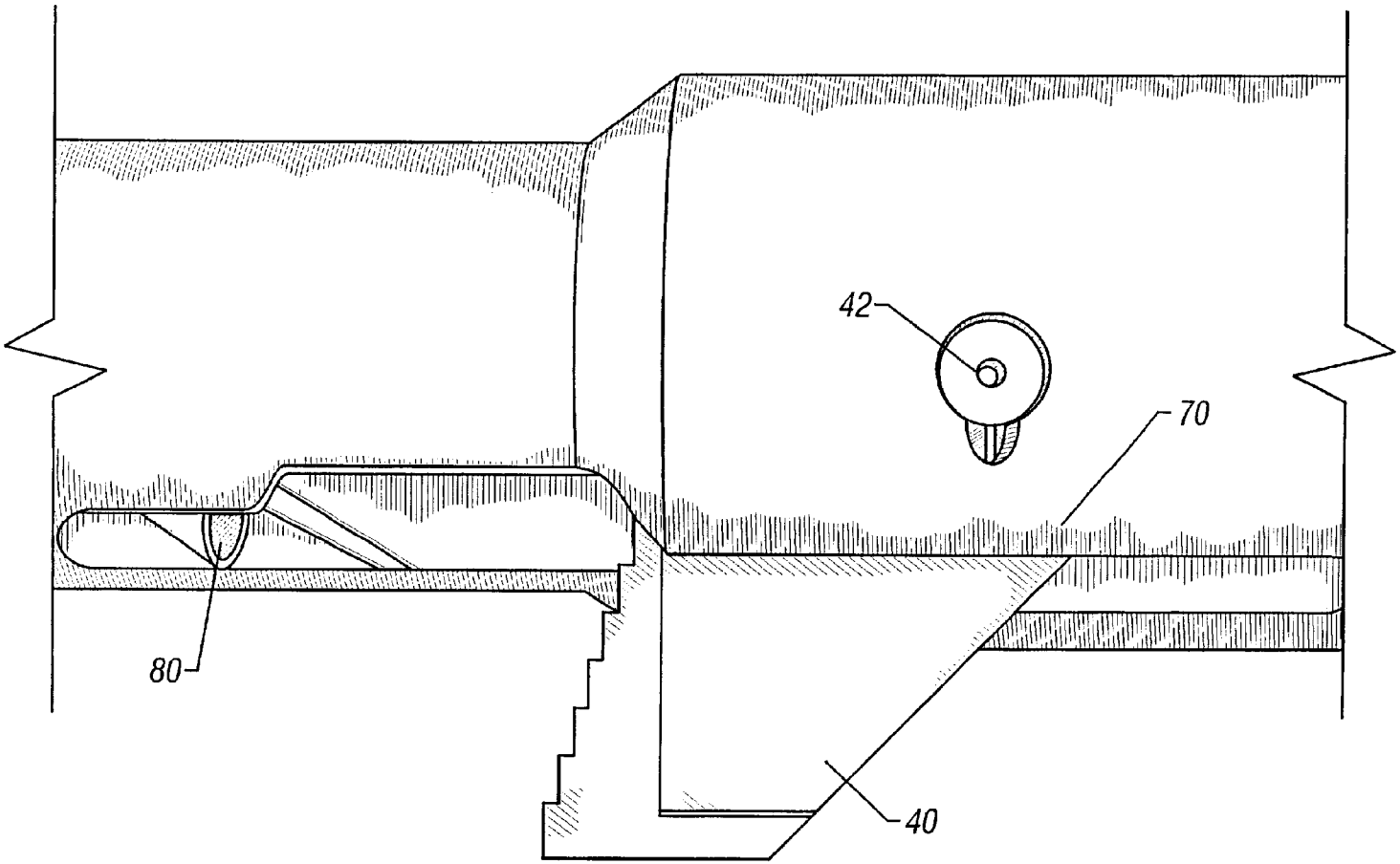
FIG. 8 is a perspective view of the underreamer body showing a cutter extended.

As may be more fully appreciated in FIG. 2 once differential pressure across upper piston surface 11' has overcome the resistance of the resilient member 60, to move piston actuator 20 into engagement with cutter ear 50 and thus cooperatively moved the cutter 40 out into engagement with the wellbore WB (see FIG. 3), underreaming or stabilization may be commenced. FIG. 8 is a perspective view that shows the cutter 40 (without carbide buttons or other cutting surfacing) in its extended position. The pivoting action of the longitudinal movement of the piston actuator 20 which engages the ear 50 on the cutter 40 which pivots about the pin 42 shown in the views from FIG. 1 and FIG. 2. The underreamer lower body 70 is also provided with ports and jets 80 for directing fluid into the annulus of the well bore to carry cuttings (not shown) from the well bore up. Resilient member 60 and resilient member extender 60' return the piston actuator 20 to the closed position when differential pressure is removed thereby closing the arms so the underreamer can be moved into and out of position for its intended use. Cutters 40 as shown in FIG. 2 are preferably provided with tungsten carbide inserts 90 in the manner more fully disclosed in applicant's prior patent, U.S. Pat. No. 5,035,293, which is incorporated herein by reference. Other forms of cutters, cutting elements and hardfacing may be substituted in manner well known to the drilling industry without departing from the scope of this invention, such as without limitation, polycrystalline diamond cutters, thermostable diamond composites, and sintered coatings of all kinds.

Figure 3:
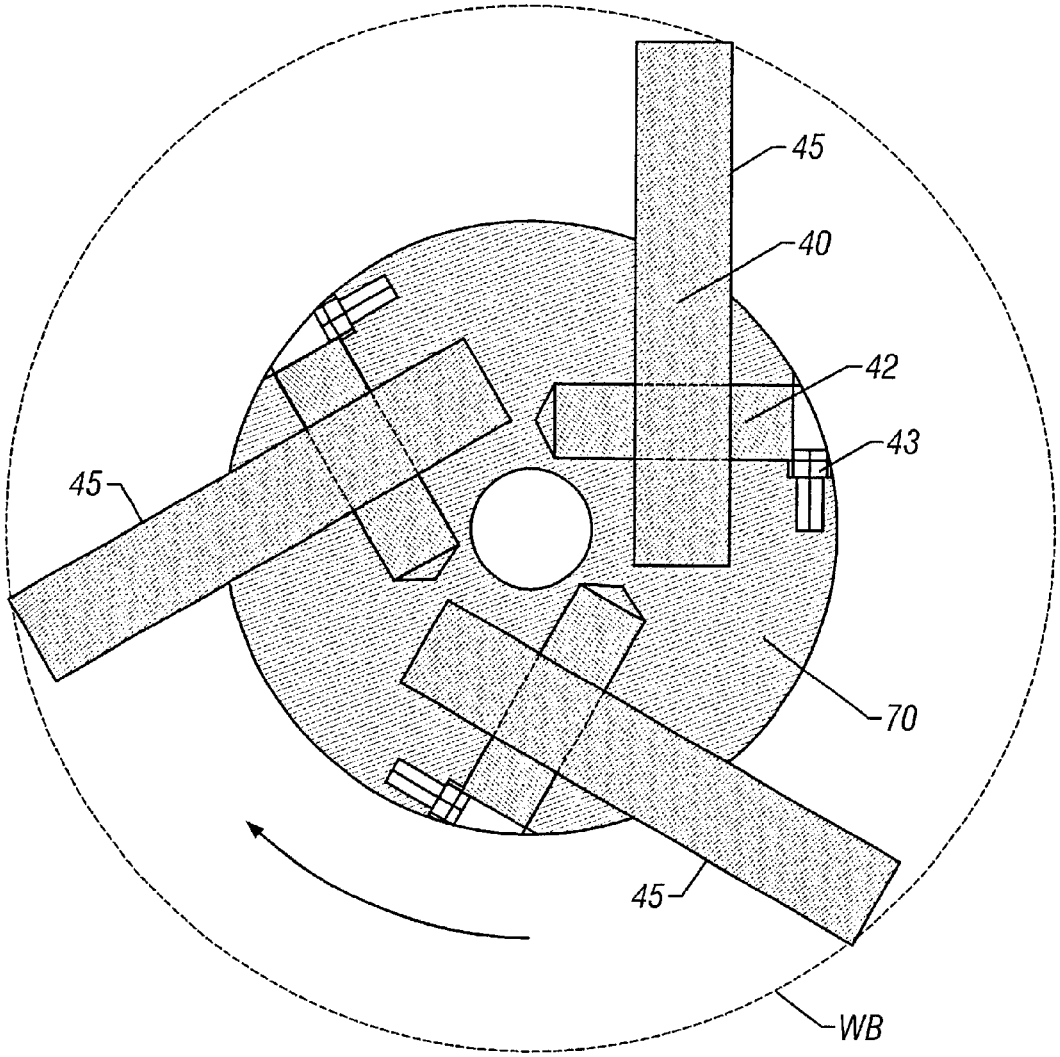
FIG. 3 is a cross-sectional end view of the underreamer in its open position.

FIG. 3 is a cross-sectional view of the extended cutters 40 showing schematically the engagement of the cutters 40 with the well bore WB. As previously noted, the cutters 40 are rotatably pinned to underreamer body 70 by pins 42. Pins 42 are held in the underreamer body 70 by cap head screws 43 that are mounted in a groove or slot machined and counterbored in the underreamer body 70 to provide an engagement surface. Each pin 42 is countersunk and tapped (not shown) to permit the easy removal of the pins 42. The skewed orientation of the pivot pins 42 in the underreamer body 70 allows an unrestricted flow path through the inner passage of the underreamer 5 and permits the maintenance of adequate working pressure below the underreamer such as at the drill bit (not shown). The orientation of the cutters 40 within the body 70 also permit the cutters 40 to engage the surface of the well bore WB at an oblique angle, thus permitting more precise cutting and evacuation of the cuttings from the well bore. This centering action of the cutters 40 provides clean and straight underreamed sections.

Figure 11:
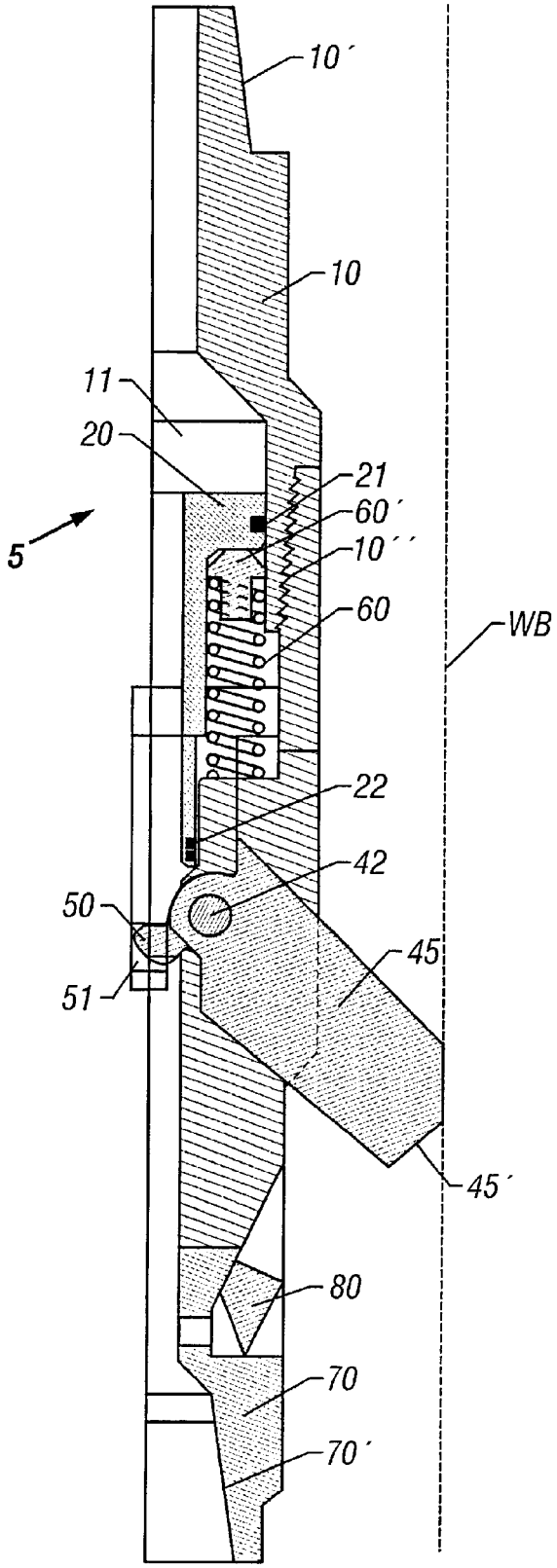
FIG. 11 is a sectional side view of the underreamer adapted for use as a downhole stabilizer.

Prior art underreamers were not sufficiently sturdy to act as stabilizers to maintain downhole assemblies in the central portion of the well bore. The present invention has sufficient strength and stability to act as a stabilizer. FIG. 11 shows the present invention with hardfacing 45' on the outer surface of the blade 45 which is mounted on the underreamer body 70 in the same manner and is functionally activated in the same manner as the underreamer 5 described herein.

The underreamer 5 of the present invention is short and may be placed immediately adjacent a drill bit, for example, a polycrystalline diamond (PDC) bit, for example, for drilling directional or horizontal holes. The length of the underreamer allows its use between a PDC bit and a downhole drilling motor. This permits the drilling and underreaming to occur in one trip into the hole without the need to drill a pilot hole, then remove the drilling assembly before using the underreamer.

With the present invention, a downhole motor may be connected to the underreamer and be effectively controlled because of the shortened length of the underreamer. This relative shortness permits the operator to steer the drill bit and underreamer to the desired location. By changing out the upper sub 10 of the underreamer 5, a normal fishing neck may also be placed on the underreamer 5 allowing its using in normal or conventional underreaming programs. When used to steerably drill a hole to a given deviation, the present invention is connected to the drill string between a drill bit and a steerable downhole motor. Steering measurement devices such as MWD, steering tools, and the like are run above the motor, with drill collars and drill pipe to the surface in a manner well known to those skilled in the art. The drilling assembly is lowered into the hole to the appropriate depth. Mud pumps are engaged to pump fluid through the drill string. As the flow is increased, a pressure drop occurs between the inside of the drill string and the outside of the drill string. The pressure drop and flow cause the motor to rotate the underreamer 5 and drill bit. As the flow continues to increase, the motor turns faster and the pressure drop increases sufficiently to open the blades or cutters 40 on the underreamer 5. The drill string is lowered thereby engaging the bit and underreamer blades or cutters 40 with the formation to be cut and removed. The hole is steered in the desired direction by changing the orientation of the drill string while monitoring the steering devices to make sure the hole is guided on its pre-determined path. Methods of steering and guidance are well known to those skilled in the art. Upon reaching the target, the mud pumps are disengaged reducing flow to zero and causing the pressure to drop to zero. When this occurs, the downhole motor stops rotating and the resilient members 60 retract the underreamer cutters 40 to the closed position. The assembly is then removed from the hole.

Figure 12:
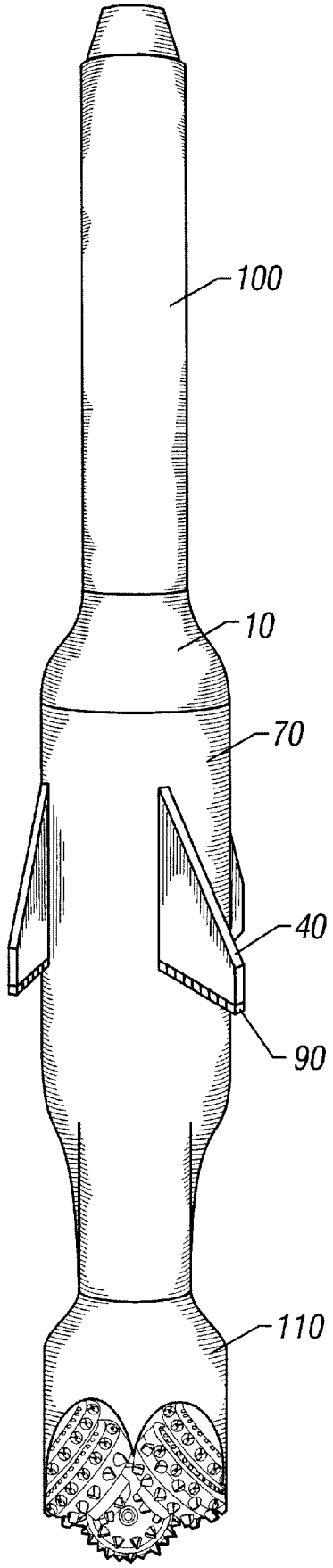
FIG. 12 is a schematic illustration of the use of the underreamer invention shown being run between a downhole motor and a pilot tricone bit.

FIG. 12 is a schematic representation of the underreamer 5 described herein with its cutters 40 extended and connected between the downhole motor 100 and a tricone bit 110 in a configuration that permit continuous drilling and underreaming. As noted previously, because of the shortened length of the present underreamer 5 compared to similar devices, the tricone bit 110 in FIG. 12, could be replaced with a PDC bit.

The present invention may also be used to simultaneously drill and underream without a downhole motor. This method is used when a straight hole is desired instead of a directional hole. The underreamer 5 is installed in the drill string above the drill bit. The drill bit may be installed directly to the underreamer 5, or drill collars may be installed between the bit and the underreamer 5. The drilling assembly is lowered into the hole to the desired depth. The drill string is then rotated by the rotary table or top drive; again, as is well known in the industry. After rotation is established, the mud pumps are engaged creating flow and pressure drop. As the pressure drop increases, the blades or cutters 40 of the underreamer 5 open to engage the formation. The drill string is lowered thereby engaging the formation to be removed. Upon reaching the desired depth, the pumps are disengaged and rotation is stopped. The blades retract as above and the drilling assembly is removed from the hole.

Another use for the present invention is to underream a previously drilled hole to a larger diameter. A drilling assembly is made up as previously described, except that a bull nose or bit may be used below the underreamer 5 to cause the underreamer 5 to follow the previously drilled hole. The operation would proceed as previously described. The present invention may also be used to stabilize a hole that is being drilled and underreamed simultaneously. When used in this fashion, the present invention is fitted with stabilizer blades 45, with hardfacing 45', as shown in FIG. 11 and is run above the underreamer 5 and drill bit. The preferred location for the stabilizer/underreamer 5 (when used for a stabilizer) would be between 30 to 90 feet above the underreamer. The stabilizer/underreamer 5 (as shown in FIG. 11) above the underreamer would help maintain a straighter hole when drilling and underreaming simultaneously. Operation is the same as previously described in normal drilling operations. The blades 45 of the underreamer used as a stabilizer engaged the well bore when a differential pressure is applied, thereby preventing whipping and "walking off" of the drill string as the drilling proceeds. When the hole reaches the desired depth, the pumps are disengaged and the blades retract permitting removal of the drill string from the well bore.

The size, flexibility of makeup and strength of the present underreamer allow it to be used in a number of drilling applications. Other uses of the present invention may be readily appreciated from a review of the drawings and description contained herein.

What is claimed is:

1. An apparatus comprising:

a tubular body having
- threaded connections at each end,
- an interior surface forming
  - a longitudinal bore through said tubular body and an annular lip within said tubular body, and
- a plurality of skewed, longitudinal grooves formed in said body;

a piston actuator having
- a lower surface,
- a plurality of slotted extensions and
- a longitudinal flow path through said piston actuator assembly, wherein
  - said piston actuator slideably and sealingly engages the interior surface;

a plurality of arms, each of said arms having
- a pivot and
- an ear,
- wherein each of said plurality of arms is pivotally mounted in a corresponding one of said plurality of skewed, longitudinal grooves and
- wherein said ear is adjacent to said pivot and engages a corresponding one of said plurality of slotted extensions; and a plurality of resilient members,
- wherein each of said plurality of resilient members has a first end and a second end,
- is located adjacent to a corresponding one of said plurality of slotted extensions,
- the first end engages the lower surface of the piston actuator assembly, and
- the second end engages the annular lip.

2. The apparatus according to claim 1 wherein each of the pivotally mounted arms has a distal end and cutting elements on said distal end whereby the apparatus may be used for underreaming.

3. The apparatus according to claim 2 wherein cutting elements are tungsten carbide buttons.

4. The apparatus according to claim 2 wherein the cutting elements are polycrystalline diamond cutter inserts.

5. The apparatus according to claim 1 wherein each of the pivotally mounted arms has a distal edge and hardfacing on said distal edge whereby the apparatus may be used as an stabilizer.

6. The apparatus according to claim 1 wherein the profile of each said plurality of slotted extensions lockingly mates with the ear of a corresponding one of plurality of the pivotally mounted arms upon their movement out of the skewed grooves in said tubular body.

7. The apparatus according to claim 1 wherein said apparatus has an annular fluid flowpath therethrough which Is substantially the same diameter therethrough.

8. An underreamer comprising:

a tubular upper body, threadably connectable to a drill string, said tubular upper body having a lower end and an upper end each with a different internal diameter, wherein the inner diameter of the lower end is larger than the inner diameter of the upper end;

a tubular lower body removably attached to the lower end of the tubular upper body, said tubular lower body having at least three skewed, longitudinal grooves and an interior surface defining a longitudinal bore therethrough and an annular lip within the tubular lower body;

a piston actuator having a longitudinal annular bore, at least three extensions, each having a slot formed thereon, and upper and lower portions, wherein said upper portion slideably and sealingly engages the interior surface of the lower end and wherein the lower portion slideably and sealingly engages the interior surface of tubular lower body and has a lower surface;

at least three pins;

at least three cutters, each having an ear formed thereon, wherein each of the cutters is pivotally attached within a corresponding one of said at least three skewed, longitudinal grooves using one of the at least three pins and wherein said ear engages the slot of a corresponding one of said at least three extensions; and at least one resilient member positioned between the lower surface of piston actuator assembly and the annular lip of the tubular lower body, said at least one resilient member resisting downward longitudinal movement of the piston actuator assembly.

9. The underreamer according to claim 8 wherein each of the at least three cutters is fitted with tungsten carbide buttons.

10. The underreamer according to claim 8 wherein each of the at least three cutters are fitted with polycrystalline diamond cutter inserts.

11. The underreamer according to claim 8 wherein each of the at least three cutters are fitted with thermostable diamond composites.

12. The underreamer according to claim 8 wherein the underreamer has an annular fluid flowpath therethrough which is substantially the same diameter therethrough.

13. A method of underreaming and directional drilling comprising:

connecting the apparatus of claim 2 to a drill string between a directional drilling motor and a drill bit;

inserting the drill string into a well bore formation and increasing the flow rate through mud pumps to circulate fluid through the drill string and the apparatus to overcome the resistance of the resilient member and engage the cutters against the well bore; and, upon completing the drilling and underreaming in the desired range; thereafter lowering the flow rate of the mud pumps allowing the resilient member to expand to its relaxed state length, thereby retracting the cutters into the grooves and disengaging the apparatus of claim 2 and withdrawing the apparatus of claim 2 and directional drilling motor from the well bore.

14. A method of stabilizing a drill string comprising:

connecting the apparatus of claim 3 to a drill string between a drill collar and a drill bit;

inserting the drill string into a well bore formation and increasing the flow rate through mud pumps to circulate fluid through the drill string and the apparatus to overcome the resistance of the resilient member and engage the apparatus of claim 3 against the well bore; and, upon completing the drilling; thereafter lowering the flow rate of the mud pumps to disengage the apparatus of claim 3 and withdrawing the apparatus of claim 3 from the well bore.

15. An underreamer to be run on a drill string, the underreamer comprising:

a tubular body having an outer profile and an inner bore;

a plurality of extension arms pivotably housed within said tubular body, said extension arms having an extended position and a retracted position;

said extension arms configured to extend from said outer profile in a skewed, non-radial alignment;

each of said extension arms having an ear adjacent a pivot point;

a piston assembly slidably engaged within said inner bore, said piston actuator including a plurality of longitudinal extensions, said extensions having slots therethrough;

each said slots configured to receive and manipulate a corresponding ear of said extension arms;

said extension arms rotating around said pivot point from said retracted position to said extended position when said piston assembly is actuated from a rest state to a loaded state; and a plurality of resilient members to bias said piston assembly into said rest state.

16. The underreamer of claim 15 wherein each of the extension arms has a distal end and cutting elements thereon.

17. The underreamer of claim 16 wherein the cutting elements are tungsten carbide buttons.

18. The underreamer of claim 16 wherein the cutting elements are polycrystalline diamond cutter inserts.

19. The underreamer of claim 15 wherein each of the extension arms has a distal edge and hard facing on said distal edge whereby the underreamer may be used as a stabilizer.

20. The underreamer of claim 15 further comprising an annular fluid flowpath therethrough, wherein said flowpath is substantially the same diameter therethrough.

21. An underreamer comprising:

a tubular upper body, said tubular upper body having an upper end and a lower end, said upper end having an inner diameter smaller than an inner diameter of said lower end;

said inner diameter of said lower body of said lower end defining a first sealing surface;

a tubular lower body removably attached to said lower end of said upper body, said tubular lower body having an interior surface and an exterior profile;

said interior surface defining a longitudinal bore therethrough and an annular lip therein, wherein said longitudinal bore defines a second sealing surface below said annular lip;

said exterior profile having a plurality of skewed longitudinal grooves, said longitudinal grooves each configured to receive a cutter;

said cutters configured to pivotally extend and retract from said longitudinal grooves, each of said cutters secured within said grooves by a pin and each of said cutters having an ear formed thereon;

a piston actuator slidably engaged within said longitudinal bore, said piston actuator configured to sealingly engage both said first sealing surface and said second sealing surface;

said piston actuator having a plurality of extensions each with a slot formed thereon, said slots of said extensions configured to engage one of said ears of said cutters; and said cutters being deployed or retracted by said ears as said piston actuator and said extensions thereof are reciprocated within said longitudinal bore.

* * * * *